US008086127B2

(12) United States Patent
Gross et al.

(10) Patent No.: US 8,086,127 B2
(45) Date of Patent: Dec. 27, 2011

(54) ADAPTIVE TRANSFER PERFORMANCE REGULATION BY FEEDBACK AND CONTROL

(75) Inventors: Eric M. Gross, Rochester, NY (US); Faming Li, Perfield, NY (US)

(73) Assignee: Xerox Corporation, Norwalk, CT (US)

( * ) Notice: Subject to any disclaimer, the term of this patent is extended or adjusted under 35 U.S.C. 154(b) by 677 days.

(21) Appl. No.: 12/243,575

(22) Filed: Oct. 1, 2008

(65) Prior Publication Data

US 2010/0080596 A1 Apr. 1, 2010

(51) Int. Cl.
*G03G 15/16* (2006.01)

(52) U.S. Cl. ..... 399/66; 399/49

(58) Field of Classification Search ..... 399/66, 399/49, 129

See application file for complete search history.

(56) References Cited

U.S. PATENT DOCUMENTS

| | | | | |
|---|---|---|---|---|
| 5,710,958 | A * | 1/1998 | Raj | 399/49 |
| 7,379,684 | B2 * | 5/2008 | Julien | 399/49 |
| 2009/0180790 | A1 * | 7/2009 | Gross et al. | 399/66 |

* cited by examiner

*Primary Examiner* — Sophia S Chen

(74) *Attorney, Agent, or Firm* — Oliff & Berridge, PLC

(57) ABSTRACT

An adaptive approach is described that maximizes xerographic transfer efficiency, i.e. minimizes post toner image transfer residual mass, in response to changes in operational conditions, variations in material, and/or changes in other factors that may otherwise adversely affect xerographic transfer efficiency. The described approach may be used during a set up phase, or startup phase, of a xerographic system to determine an initial transfer field that provides a desired level of toner image transfer efficiency. The described approach may also be used in real time to dynamically adjust a transfer field to maintain a desired level of transfer efficiency. The described approach allows optimal toner image transfer efficiency to be achieved despite changes in the operational environments, and/or changes in the materials, e.g., paper, toner, etc., being processed.

20 Claims, 8 Drawing Sheets

ADAPTIVE TRANSFER PERFORMANCE REGULATION BY FEEDBACK AND CONTROL

BACKGROUND

This disclosure generally relates to control of xerographic marking engines, such as copiers and laser printers.

The basic xerographic process used in a xerographic imaging device generally involves an initial step of charging a photoconductive member to a substantially uniform potential, $V_{charge}$. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the document being produced. The latent image is then developed by bringing a developer material including toner particles adhering triboelectrically to carrier granules into contact with the latent image. The toner particles are attracted away from the carrier granules to the latent image, forming a toner image on the photoconductive member which may be transferred, during a process that may be referred to as a transfer stage, directly to a copy sheet or transferred to an intermediate transfer belt and subsequently transferred to a copy sheet. The copy sheet having the toner image thereon is then advanced to a fusing station for permanently affixing the toner image to the copy sheet in an image configuration.

During a transfer stage of the example xerographic process cycle, described above, an electric transfer field, hereafter referred to as a transfer field, may be applied to a transfer target to facilitate the transfer of the toner image from a transfer source to the transfer target. For example, if a toner image is to be transferred from a photoreceptor to paper, a transfer field may be applied to the paper to facilitate the transfer of the toner image to the paper; if a toner image is to be transferred from a photoreceptor to an intermediate transfer belt, a transfer field may be applied to the intermediate transfer belt to facilitate the transfer of the toner image from the photoreceptor to the intermediate transfer belt; and if a toner image is to be transferred from an intermediate transfer belt to paper, a transfer field may be applied to the paper to facilitate the transfer of the toner image from the intermediate transfer belt to the paper.

To maximize the efficiency of the toner image transfer process, i.e., the transfer efficiency, the transfer field applied to the transfer target is manually set to a value that reduces transfer associated IQ defects while keeping toner waste to a minimum. Further, the applied transfer field may be regulated to assure that the selected set point is maintained. However, such fixed transfer fields are static, or are only changed based on open loop information such as paper type or humidity, and are not automatically adjusted based on feedback measurements to maintain a desired transfer efficiency in response to variations in operational conditions and/or variations in the materials, e.g., paper type, paper humidity, toner type, toner age/condition, that may adversely affect transfer efficiency, and/or other noise. The inability to dynamically adjust xerographic process transfer fields adversely affects image quality and increases operating cost by wasting toner that otherwise would have been included in the printed xerographic output.

SUMMARY

An adaptive (i.e., learning) approach is described that dynamically improves toner image transfer efficiency, i.e. minimizes post toner image transfer residual mass, in response to changes in operational conditions, variations in material, and/or changes in other factors that may otherwise adversely affect toner image transfer efficiency. The described approach may be used during a set up phase, or startup phase, of a xerographic system to determine an initial transfer field that provides a desired level of toner image transfer efficiency. The described approach may also be used in real time to dynamically adjust a transfer field to maintain a desired level of toner image transfer efficiency.

A toner residual mass and/or a toner transfer efficiency may be measured during a set up or in real time, for example, using one or more residual mass per area (RM/A) optical sensing devices, such as extended toner area coverage (ETAC) sensors or area density coverage (ADC) sensors, or other sensors, capable of providing a measure of toner on a photoreceptor or intermediate transfer belt. For example, positioning such sensors at locations in a xerographic process after a point at which toner image transfers from a photoreceptor or intermediate transfer belt are performed, allows post image transfer RM/A sensor signals to be generated. By positioning such sensors at locations in a xerographic process both before and after a point at which toner image transfers from a photoreceptor or intermediate transfer belt are performed, allows a transfer efficiency signal to be produced.

Depending on the configuration of a xerographic system, multiple pre-transfer and post-transfer optical sensing devices may be used. For example, a xerographic system that includes several, e.g., four, photoconductor imaging apparatus may include an RM/A sensing device proximate to each photoconductor at a location where the RM/A sensing device may generate an output signal that may include a measure of toner remaining on the photoconductor after a toner image transfer has been performed, but before the photoconductor has been cleaned of excess toner. Further, if such a xerographic system includes one or more intermediate transfer belts, the xerographic system may also include an RM/A sensing device proximate to each intermediate transfer belt at a location where the RM/A sensing device may generate an output signal that may include a measure of toner remaining on the respective intermediate transfer belt, after a toner image transfer has been performed, but before the intermediate transfer belt has been cleaned of excess toner. In both examples, if sensors are placed at locations in the xerographic process both before and after a point at which toner image transfers from a photoreceptor or intermediate transfer belt are performed, the respective pre-transfer and post-transfer signals may be used to generate an output signal that may include a measure of transfer efficiency.

In xerographic systems that use an intermediate transfer belt, assuming that the toner image transfer of interest is between the photoconductor and the intermediate transfer belt rather than between the intermediate transfer belt and paper, the toner image transferred from a photoreceptor to the intermediate transfer belt may be discarded without a subsequent transfer from the intermediate transfer belt to paper, thereby reducing paper consumption. However, in xerographic systems in which the one or more toner image transfers of interest include a transfer to paper, any paper to which a test toner image is transferred may be automatically discarded.

Toner patches used to adjust the respective transfer fields may be applied to inter-document zones on the photoconductor and, in systems with an intermediate transfer belt, toner patches used to adjust the respective transfer fields may be applied to inter-document zones on the intermediate transfer belt. In this manner, the described control processes for dynamically adjusting transfer efficiency may be performed concurrently with, and without adversely affecting, normal print operations. It is to be understood that the latter approach will compensate for transfer efficiency loss due to material state changes but will not include measurements of the impact of the paper properties on transfer performance.

The disclosure describes a method of adjusting a transfer field within a marking engine that may include, applying a first transfer field to a transfer device based on a first transfer field signal, modifying the first transfer field based on a first transfer field perturbation signal modified with the first transfer field signal, transferring a toner image from a toner image source to a toner image destination via the transfer device with the modified first transfer field, receiving a signal based at least in part on a residual toner mass remaining on the toner image source after the transfer, determining a slope of the received signal, adjusting the first transfer field signal to produce a second transfer field signal based on the slope of the received signal, and iterating as required.

Further, the disclosure describes a xerographic marking engine that may include, a transfer field controller that may generate a first transfer field control signal, an analysis unit that may generate a perturbation control signal, a transfer field high voltage power source that may generate a transfer field driving signal based on the first transfer field control signal and the perturbation control signal, one or more toner image transfer devices that may transfer a toner image from a toner image source to a toner image destination using a transfer field generated based on the transfer field driving signal, and one or more sensors that may generate a sensor signal based at least in part on a residual toner mass remaining on the toner image source after the transfer, in which the analysis unit may update the first transfer field control signal based on the sensor signal.

BRIEF DESCRIPTION OF THE DRAWINGS

Exemplary embodiments will be described with reference to the accompanying drawings, where like numerals represent like parts, and in which.

EMBODIMENTS

Figure 1:
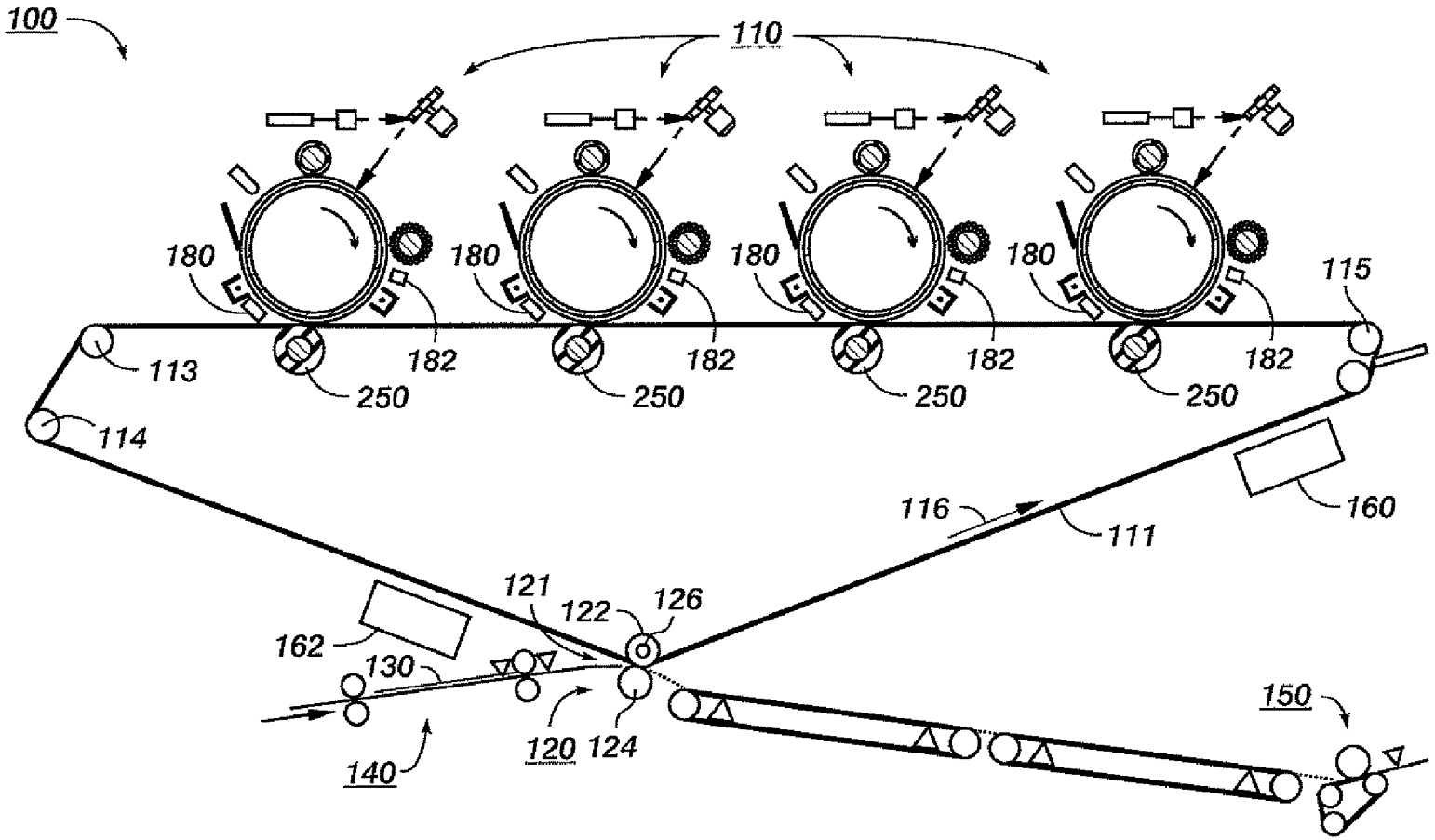
FIG. 1 is a schematic representation of a xerographic apparatus in which embodiments may be employed.

FIG. 1 is a schematic of an exemplary xerographic apparatus 100. Although embodiments will be described with reference to the embodiment shown in the drawings, it should be understood that embodiments may be employed in many alternate forms. In addition, any suitable size, shape or type of elements or materials could be used without departing from the spirit of the invention.

As shown in FIG. 1, the xerographic apparatus 100 may include at least one image forming apparatus 110, each of substantially identical construction, that may apply a color of toner (or black). In the example of FIG. 1, there are four image forming apparatus, or imaging apparatus, 110 which may apply, for example, cyan, magenta, yellow, and/or kappa/black toner, respectively. Each image forming apparatus may be equipped with a post-transfer photoreceptor residual mass per area (RM/A) sensor 180, such as an extended toner area coverage (ETAC) sensor or an area density coverage (ADC) sensor, or other sensor, capable of providing a measure of toner remaining on the photoreceptor after a toner image transfer from the photoreceptor to an intermediate transfer belt 111 has been performed, but before the photoconductor has been cleaned of excess toner. Further, each image forming apparatus may be equipped with a pre-transfer photoreceptor RM/A sensor 182, such as an ETAC sensor or an ADC sensor, or other sensor, capable of providing a measure of toner placed on the photoreceptor prior to the image transfer. In this manner, the effectiveness of the image transfer may be based on feedback from post-transfer photoreceptor RM/A sensor 180, alone, or, feedback from both post-transfer photoreceptor RM/A sensor 180 and pre-transfer photoreceptor RM/A sensor 182. For example, feedback from both post-transfer photoreceptor RM/A sensor 180 and pre-transfer photoreceptor RM/A sensor 182 may be used to produce an output signal that measures the transfer efficiency of the image transfer.

The intermediate transfer belt 111 may be mounted about at least one tensioning roller 113, steering roller 114, and drive roller 115. As the drive roller 115 rotates, it moves the intermediate transfer belt 111 in the direction of arrow 116 to advance the intermediate transfer belt 111 through the various processing stations disposed about the path of the belt 111. Once the toner image has been completed on the belt 111 by having toner deposited, if appropriate, by each imaging apparatus 110, the complete toner image is moved to the intermediate transfer belt transfer station 120.

The intermediate transfer belt transfer station 120 may transfer the toner image to paper or other media 130 carried to the transfer station by transport system 140. The media may then pass through a fusing station 150 to fix the toner image on the media 130. Many xerographic printers 100 use at least one biased transfer roller 124 for transferring imaged toner to sheet-type media 130 as shown and according to embodiments, though it should be understood that embodiments can be employed with continuous rolls of media or other forms of media without departing from the broader aspects of embodiments.

As shown in FIG. 1, the intermediate transfer belt transfer station 120 may include at least one backup roller 122 on one side of the intermediate transfer belt 111. The backup roller 122 may form a nip 121 on the belt 111 with a biased transfer roller 124 so that media 130 passes over the transfer roller 124 in close proximity to or in contact with the complete toner image on the intermediate transfer belt 111. The transfer roller 124 may act with the backup roll 122 to transfer the toner image by applying high voltage to the surface of the transfer roller 124, such as with a steel roller. The backup roller 122 may be mounted on a shaft 126 that may be grounded, which creates an electric field that pulls the toner image from the intermediate transfer belt 111 onto the substrate 130. The sheet transport system 140 then directs the media 130 to the fusing station 150 and on to a handling system, catch tray, or the like (not shown).

Alternatively, in embodiments the backup roller 122 may be mounted on a shaft that is biased. As described above, the biased transfer roller 124 may be mounted on a shaft 126 that may be grounded, which creates an electric field that pulls the toner image from the intermediate transfer belt 111 onto the substrate 130. Alternatively, the shaft of the backup roller 122 may be biased while the shaft 126 on the biased transfer roller 124 may be grounded. The sheet transport system 140 may then direct the media 130 to the fusing station 150 and on to a handling system, catch tray, or the like (not shown).

As shown in FIG. 1, intermediate transfer belt 111 may be equipped with an intermediate transfer belt post-transfer RM/A sensor 160, such as an ETAC sensor or an ADC sensor, or other sensor, capable of providing a measure of toner remaining on intermediate transfer belt 111 after a toner image transfer from intermediate transfer belt 111 to paper, or to another intermediate transfer belt, has been performed, but before intermediate transfer belt 111 has been cleaned of excess toner. Further, intermediate transfer belt 111 may be equipped with an intermediate transfer belt pre-transfer RM/A sensor 162, such as an ETAC sensor or an ADC sensor, or other sensor, capable of providing a measure of toner placed on the photoreceptor prior to the image transfer. In this manner, the effectiveness of the image transfer may be based on feedback from intermediate transfer belt post-transfer RM/A sensor 160, alone, or, feedback from both intermediate transfer belt post-transfer RM/A sensor 160 and intermediate transfer belt pre-transfer RM/A sensor 162. For example, feedback from both intermediate transfer belt post-transfer RM/A sensor 160 and intermediate transfer belt pre-transfer RM/A sensor 162 may be used to produce an output signal that may provide a measure of transfer efficiency of the image transfer.

Figure 2:
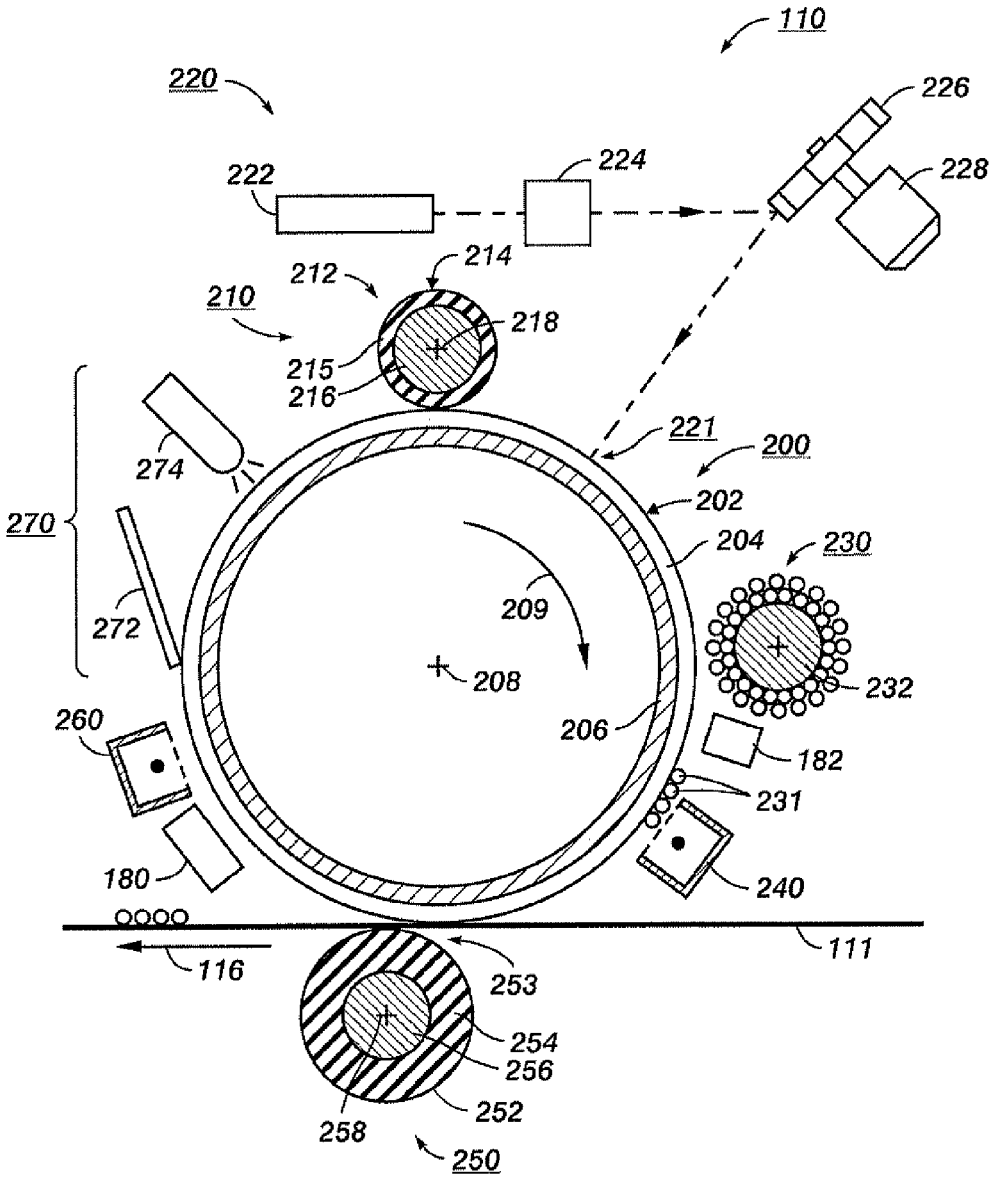
FIG. 2 is a schematic of an image forming apparatus in which embodiments may be employed, the image forming apparatus being part of a xerographic apparatus, such as that shown in FIG. 1.

FIG. 2 is a schematic of an imaging apparatus, such as imaging apparatus 110 that shown in FIG. 1. As shown in FIG. 2, each imaging apparatus 110 may include a photoreceptor 200, a photoreceptor charging station or subsystem 210, a laser scanning device or subsystem 220, such as a rasterizing output scanner, a toner deposition station or subsystem 230, a pre-transfer photoreceptor RM/A sensor 182, a pre-transfer station or subsystem 240, a photoreceptor transfer station or subsystem 250, a post-transfer photoreceptor RM/A sensor 180, a precleaning station or subsystem 260, and a cleaning/erase station 270. Although the photoreceptor 200 embodiment shown is a drum, other forms of photoreceptors may be used. The photoreceptor drum 200 may include a surface 202 of a photoconducting layer 204 on which an electrostatic charge can be formed. The photoconducting layer 204 may be mounted or formed on a cylinder 206 that is mounted for rotation on a shaft 208, such as in the direction of the arrow 209.

Figure 3A:
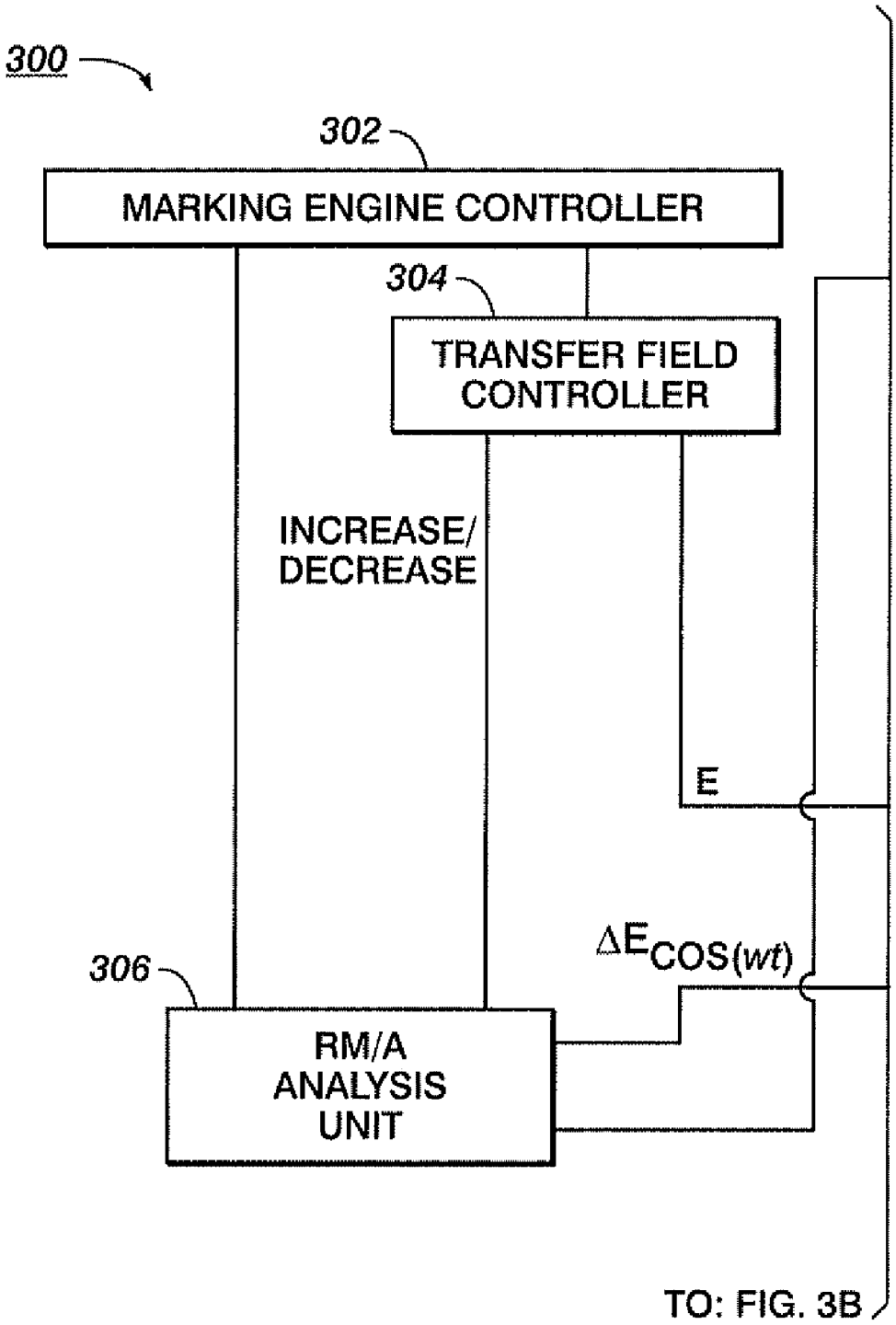
FIG. 3A and FIG. 3B are a system level schematic of a xerographic system that incorporates the exemplary xerographic apparatus of FIG. 1.
Figure 3B:
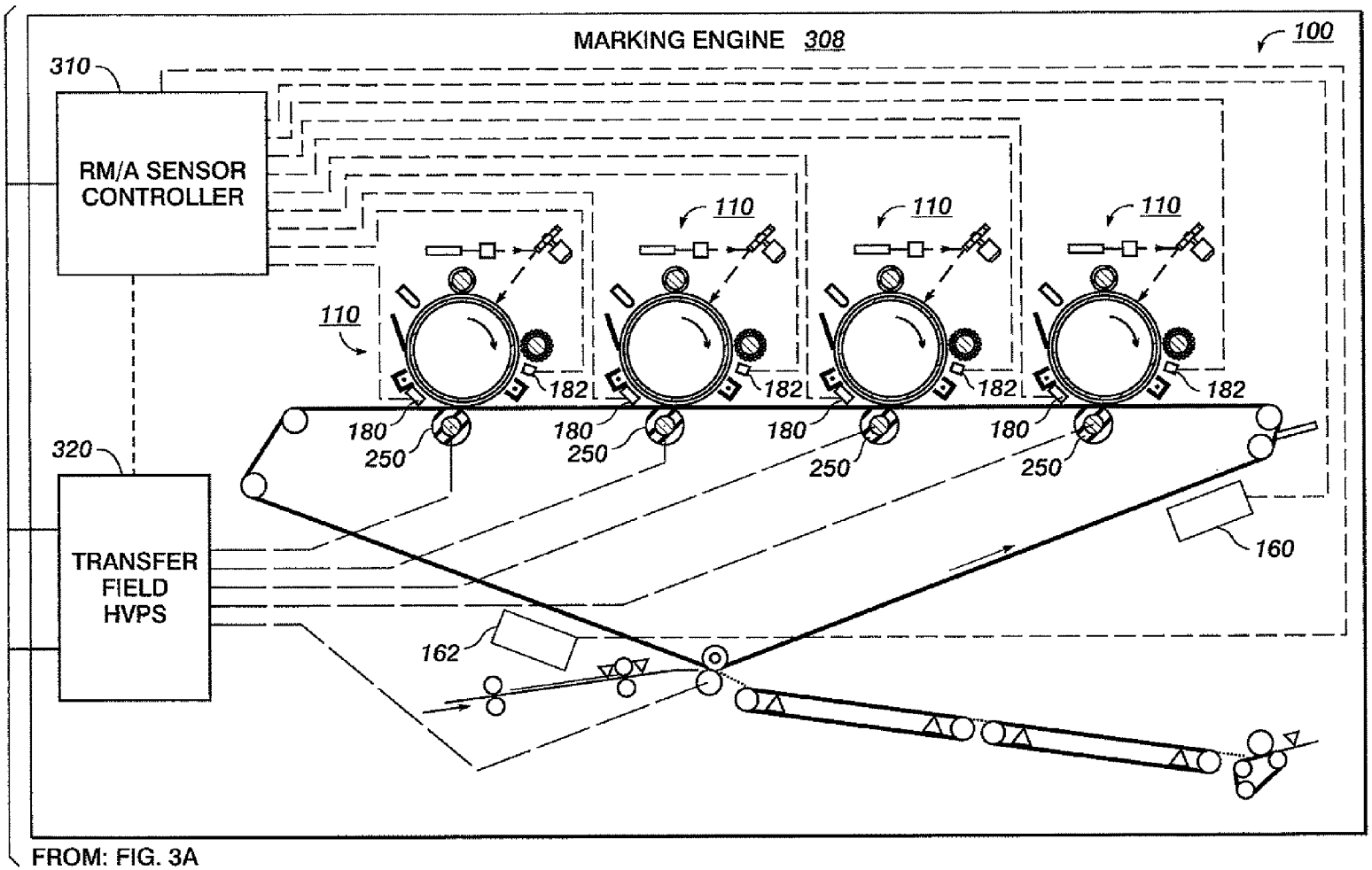

Photoreceptor charging station 210 may include a biased charging roller 212 that charges the photoreceptor 200 using a DC-biased AC voltage supplied by a high voltage power supply (shown in FIG. 3B). The biased charging roller 212 may include a surface 214 of an elastomeric layer 215 formed or mounted on an inner cylinder 216, such as a steel cylinder, though any appropriate conducting material could be used. The roller 212 may be mounted for rotation with a shaft 218 extending therethrough along a longitudinal axis of the roller 212.

The laser scanning device 220 of embodiments may include a controller 222 that modulates the output of a laser 224, such as a diode laser, whose modulated beam shines onto a rotating mirror or prism 226 rotated by a motor 228. The mirror or prism 226 reflects the modulated laser beam onto the charged PC surface 202, panning it across the width of the PC surface 202 so that the modulated beam can form a line 221 of the image to be printed on the PC surface 202. Exposed portions of the image to be printed move on to the toner deposition station 230, where toner 232 may adhere to the exposed regions of the photoconductor. The image regions of the PC, with adherent toner, then pass to the pretransfer station 240 and on to the photoreceptor transfer station 250.

The photoreceptor transfer station 250 may include a biased transfer roller 252 arranged to form a nip 253 on the intermediate transfer belt 111 for transfer of the toner image onto the intermediate transfer belt 111 In embodiments, the biased transfer roller 252 includes an elastomeric layer 254 formed or mounted on an inner cylinder 256, and the roller 252 is mounted on a shaft 258 extending along a longitudinal axis of the roller 252. The biased transfer roller 252 may carry a DC potential provided by a high voltage power supply, such as that shown in FIG. 3B. The voltage applied to the roller 252 draws the toner image 231 from the photoreceptor surface 202 to the intermediate transfer belt 111.

As shown in FIG. 2, imaging apparatus 110 may include a post-transfer photoreceptor RM/A sensor 180, such as an ETAC sensor or an ADC sensor, or other sensor, capable of providing a measure of toner remaining on photoreceptor surface 202 after a toner image has been transferred from photoreceptor surface 202 to intermediate transfer belt 111, but before photoreceptor surface 202 has been cleaned of excess toner. Further, imaging apparatus 110 may be equipped with a pre-transfer photoreceptor RM/A sensor 182, such as an ETAC sensor or an ADC sensor, or other sensor, capable of providing a measure of toner placed on the photoreceptor prior to the image transfer. In this manner, the effectiveness of the image transfer may be based on feedback from post-transfer photoreceptor RM/A sensor 180, alone, or, feedback from both post-transfer photoreceptor RM/A sensor 180 and pre-transfer photoreceptor RM/A sensor 182. For example, feedback from both post-transfer photoreceptor RM/A sensor 180 and pre-transfer photoreceptor RM/A sensor 182 may be used to produce an output signal that may include a measure of transfer efficiency of the image transfer. Post-transfer photoreceptor RM/A sensor 180 and/or pre-transfer photoreceptor RM/A sensor 182 may be periodically activated to measure residual mass per area on the photoreceptor as part of the dynamic transfer field adjustment process, as described in greater detail below.

After a measure of post-transfer toner residual mass per area has been performed, the PC surface 202 may rotate to the precleaning subsystem 260, then to the cleaning/erasing substation 270, where a blade 272 may scrapes excess toner from the PC surface 202 and an erase lamp 274 equalizes the residual charge on the PC surface.

FIG. 3A and FIG. 3B are a system level schematic of a xerographic printer system 300 that supports the described dynamic adjustment of toner image transfer fields. As shown in FIG. 3A and FIG. 3B, an exemplary xerographic printer system 300 may include a marking engine controller 302, a transfer field controller 304, an RM/A analysis controller 306, and a marking engine 308. Marking engine 308 may include an RM/A sensor controller 310, a transfer field high voltage power source 320 and an exemplary xerographic apparatus 100, described above with respect to FIG. 1, which may include example imaging apparatus 110, described above with respect to FIG. 2. Each imaging apparatus 110 in xerographic apparatus 100 may be equipped with a post-transfer photoreceptor RM/A sensor 180 and may also be equipped with a pre-transfer photoreceptor RM/A sensor 182, as described above with respect to FIG. 1 and FIG. 2. Further, intermediate transfer belt 111 may be equipped with an intermediate transfer belt post-transfer RM/A sensor 160, and may also be equipped with an intermediate transfer belt pre-transfer RM/A sensor 162, as described above with respect to FIG, 1.

As shown in FIG. 3A and FIG. 3B, marking engine controller 302 may communicate with transfer field controller 304, RM/A analysis unit 306, and marking engine 308. Transfer field controller 304 may communicate with RM/A analysis unit 306 and transfer field high voltage power source 320. RM/A analysis unit 306 may further communicate with transfer field high voltage power source 320 and RM/A sensor controller 310. RM/A sensor controller 310 may communicate with each RM/A sensor, e.g., each post-transfer photoconductor RM/A sensor 180, each pre-transfer photoreceptor RM/A sensor 182 each intermediate transfer belt post-transfer RM/A sensor 160, and each intermediate transfer belt pre-transfer RM/A sensor 162, included within xerographic apparatus 100. Transfer field high voltage power source 320 may communicate with each toner image transfer device, e.g., each biased photoconductor transfer station 250, and each intermediate transfer belt transfer station 120, included within xerographic apparatus 100.

In operation, marking engine controller 302 may control and monitor the operation of numerous subsystems and operations performed by xerographic printer system 300, in addition to those units shown in FIG. 3A and FIG. 3B. For example, in response to stored parameters and input received via a user interface, marking engine controller 302 may control and monitor the execution of print jobs executed by xerographic printer system 300, including providing marking engine 308 with data to a drive laser scanning subsystem included in each imaging apparatus 110 in xerographic apparatus 100, as described above with respect to FIG. 2. Further, marking engine controller 302 may communicate with marking engine 308 to monitor the progress of executed jobs and may receive and store print job status information from marking engine 308.

Transfer field controller 304 may control, via transfer field high voltage power source 320, the transfer field applied to each toner image transfer device, e.g., each one or more biased photoconductor transfer stations 250 and any intermediate transfer belt transfer stations 120, included within xerographic apparatus 100. Transfer field controller 304 may receive control parameters from marking engine controller 302, such as an initial transfer field to apply to each respective toner image transfer device in xerographic apparatus 100 and may periodically receive instructions from RM/A analysis unit 306 to either increase, or decrease, the transfer field applied to one or more of the respective toner image transfer devices. Transfer field controller 304 may determine an electronic field value, E, for respective toner image transfer devices based on information received from, for example, marking engine controller 302 and/or RM/A analysis unit 306, and may communicate the determined electronic field value, E, for each respective toner image transfer device to transfer field high voltage power source 320.

RMA analysis unit 306 may analyze RM/A sensor values received from RM/A sensor controller 310, as described in greater detail below, to determine whether the transfer field applied to each toner image transfer device is achieving an efficient toner image transfer. If, based on the analysis preformed, RM/A analysis unit 306 determines that greater toner image transfer efficiency may be achieved in a monitored toner image transfer device, RM/A analysis unit 306 may instruct transfer field controller 304 to either increase, or decrease, the transfer field applied to the device. In one example embodiment, the increase/decrease may be a predetermined increment. Subsequent analysis, and the resulting increases/decreases in transfer field values resulting from the analysis, allow the transfer field controller 304 to maintain toner image transfer devices at a desired level of efficiency, despite changes in the materials processed. For example, such an approach may allow transfer field controller 304 to maintain the respective toner image transfer devices within a xerographic apparatus 100 at a desired level of efficiency despite changes in the operational environment temperature and/or humidity, changes/differences in toner characteristics, changes in paper thickness and resistivity, changes in the surface wear of the photoreceptor/intermediate belt and any other changes that may affect a toner image transfer, whether the transfer be from a photoreceptor to paper, from a photoreceptor to an intermediate transfer belt, or from an intermediate transfer belt to paper.

RMA analysis unit 306 may communicate with both RM/A sensor controller 310 and transfer field high voltage power source 320 to perform a variety of operations. For example, RM/A analysis unit 306 may communicate with both RM/A sensor controller 310 and transfer field high voltage power source 320 to determine an RM/A analysis perturbation frequency, as described in greater detail below. Further, RM/A analysis unit 306 may communicate with both RM/A sensor controller 310 and transfer field high voltage power source 320 to coordinate the collection of toner residual mass per area signals using either a dynamically determined, or a predetermined, perturbation signal. RM/A analysis unit 306 may exchange status and control information from marking engine controller 302, that allows RM/A analysis unit 306 to best time the execution of such tasks without disrupting operational activities performed by xerographic apparatus 100.

For example, RM/A analysis unit 306 may coordinate with marking engine controller 302 to orchestrate the printing of solid test patches that may be used to collect RM/A sensor data values. In one example embodiment, RM/A analysis unit 306 may communicate to marking engine controller 302 that a collection of RM/A data is required. In response, marking engine controller 302 may instruct marking engine 308 to generate solid toner test patches in place of print images, may instruct marking engine 308 to automatically discard any paper output containing test patches, and may provide RM/A analysis unit 306 with timing data for use in generating and collecting RM/A analysis data.

In another example embodiment, RM/A analysis unit 306 may communicate to marking engine controller 302 that a collection of RM/A data is required. In response, marking engine controller 302 may instruct marking engine to generate solid toner test patches within an inter-document zone between production print images, and may provide RM/A analysis unit 306 with timing data regarding when a perturbation signal should be applied to generate and collect RM/A sensor data based on the inter-document zone patches. Such timing data may be used by RM/A analysis unit 306 to instruct transfer field high voltage power source 320 when to apply a perturbation signal to one or more toner image transfer devices in xerographic apparatus 100, and may be used RM/A analysis unit 306 to instruct RM/A sensor controller 310 when to pass RM/A sensor data received from one or more respective RM/A sensors in xerographic apparatus 100, to RM/A analysis unit 306 for analysis. In an embodiment in which RM/A analysis unit 306 continuously receives RM/A sensor data from RM/A sensor controller 310, the timing data may be used by RM/A analysis unit 306 to determine when data received from RM/A sensor controller 310 should be selected for and/or stored for analysis.

RMA sensor controller 310 may monitor the respective RM/A sensors within xerographic apparatus 100 and may provide RM/A sensor output values to RM/A analysis unit 306, as described above. For example, in one embodiment, RM/A sensor controller may continuously send RM/A data to RM/A analysis unit 306, for each monitored RM/A sensor, thereby allowing RM/A analysis unit 306 to determine which data to select for analysis. In another example embodiment, RM/A sensor controller may send to RM/A analysis unit 306 a continuous stream of RM/A sensor data for one or more RM/A devices requested by RM/A analysis unit 306. In yet another example embodiment, RM/A sensor controller may send to RM/A analysis unit 306 a stream of RM/A sensor data for one or more RM/A devices for a specified time period, as requested by RM/A analysis unit 306. In still another example embodiment, RM/A sensor controller may communicate with transfer field high voltage power source 320 and may send to RM/A analysis unit 306 a stream of RM/A sensor data for one or more RM/A devices only during a time period in which transfer field high voltage power source 320 has been instructed by RM/A analysis unit 306 to apply a perturbation signal.

Transfer field high voltage power source 320 may provide a high voltage power signal to one or more toner image transfer devices, e.g., each biased photoconductor transfer station 250, and each intermediate transfer belt transfer station 120, included within xerographic apparatus 100. The transfer field, E, applied to each toner image transfer device may be controlled based on information received from transfer field controller 304, as described above. Further, transfer field high voltage power source 320 may selectively apply a combined transfer field signal and perturbation signal, as described in greater detail below, based on information received from RM/A analysis unit 306. The combined transfer field/perturbation signal may be selectively applied, as described above, to generate RM/A sensor data that supports dynamic RM/A analysis, as described in greater detail below. The combined transfer field/perturbation signal may be selectively applied to one or more toner image transfer devices in accordance with a predetermined sequence and/or based on control information received from RM/A analysis unit 320. In one exemplary embodiment, each time transfer field high voltage power source 320 applies a perturbation signal to a toner image transfer device, transfer field high voltage power source 320 may concurrently provide to RM/A sensor controller 310 a signal that identifies the RM/A sensor(s) to which the perturbation signal is being applied, thereby facilitating the accurate collection of RM/A analysis data by RM/A sensor controller 310.

It is noted that FIG. 3A and FIG. 3B are a system level schematic that is not intended to reflect the exact location of the respective RM/A sensors, i.e., post-transfer photoreceptor RM/A sensor 180, pre-transfer photoreceptor RM/A sensor 182, intermediate transfer belt post-transfer RM/A sensor 160 and/or intermediate transfer belt pre-transfer RM/A sensor 162. For example, such sensors may be placed in any location that allows an accurate reading of toner residual mass per area from either a photoreceptor or an intermediate transfer belt, respectively.

Figure 4A:
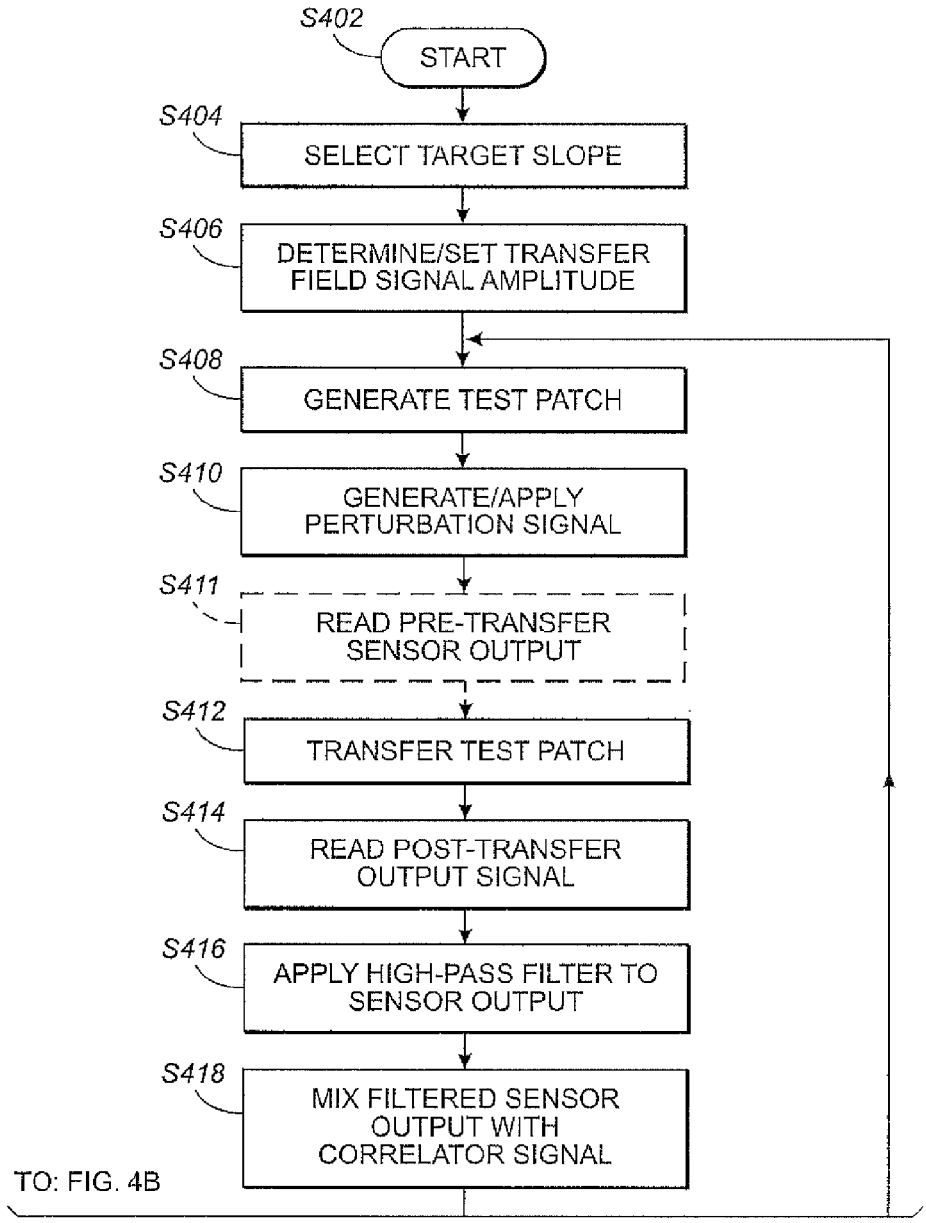
FIG. 4A and FIG. 4B are a flowchart illustrating of an exemplary method for dynamically adjusting a transfer field to obtain efficient toner image transfer.
Figure 4B:
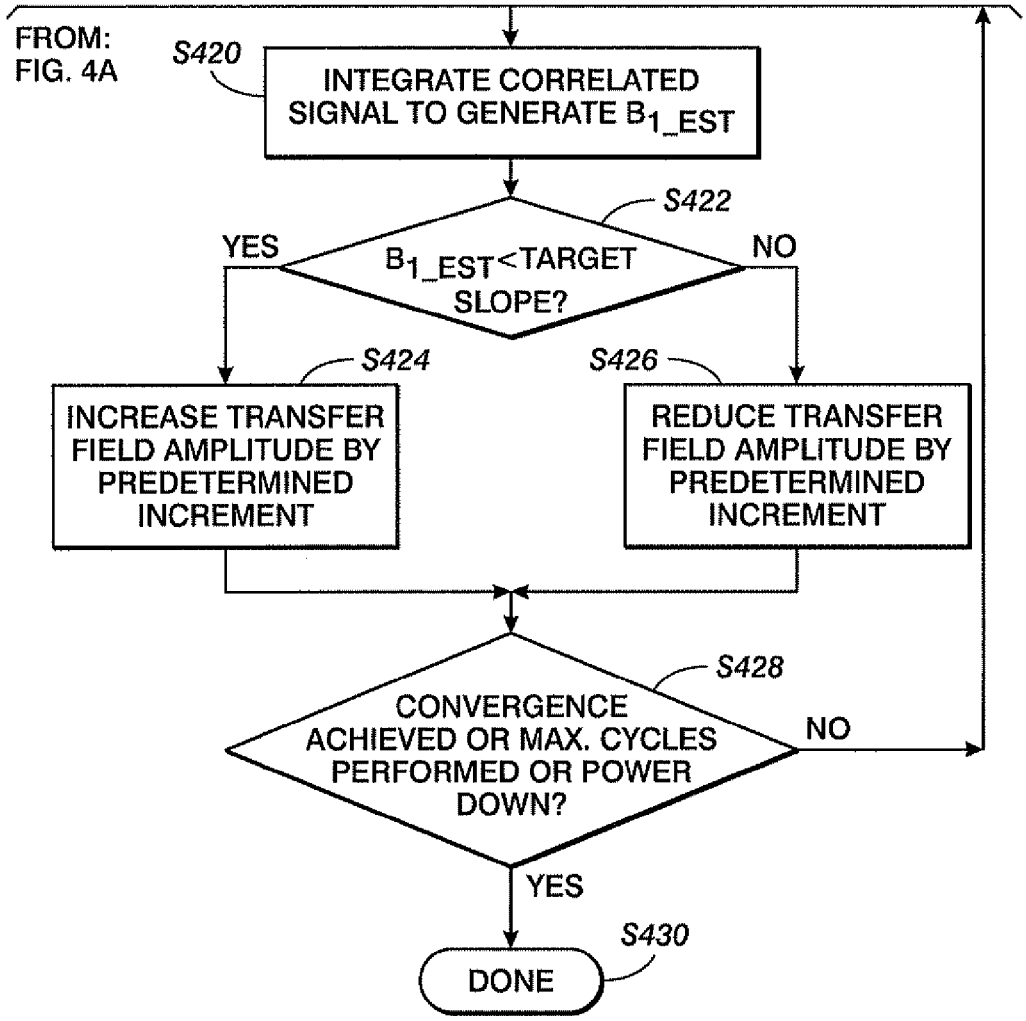

FIG. 4A and FIG. 4B are a flowchart illustrating an exemplary method for dynamically adjusting a transfer field to obtain efficient image transfer within the exemplary xerographic system of FIG. 3A and FIG. 3B. As shown in FIG. 4A and FIG. 4B, operation of the method begins at step S402 with the startup of a xerographic system and proceeds to step S404.

In step S404, the RM/A analysis unit 306 may determine and set a target slope, e.g., zero or a negative number close to zero, for use in performing the dynamic transfer field optimization process, described in greater detail below, and operation of the method continues to step S406.

In step S406, the transfer field controller 304 may determine and set, via transfer field high voltage power source 320, as described above, a transfer field signal amplitude for each toner image transfer device, and operation of the method continues to step S408.

In step 8408, at the request of RM/A analysis unit 306, marking engine controller 302, may generate and may send to marking engine 308 for rendering, one or more test patches, e.g., solid toner patches each representing a toner color used by the marking engine, and operation of the method continues to step S410.

In step S410, at the request of RM/A analysis unit 306, transfer field high voltage power source 320 may generate, and apply to one or more toner image transfer devices, a combined transfer field signal that may include the current transfer field signal setting, E, and a perturbation signal, e.g., $\Delta E \cos(\omega t)$, based on a perturbation frequency that may be selected by RM/A analysis unit 306, and operation of the method continues to step S411.

In step S411, assuming that the xerographic system includes a pre-transfer RM/A sensor, RM/A analysis unit 306 may receive an RM/A sensor signal containing RM/A sensor data corresponding to a toner image prior to the toner image transfer, and operation of the method continues to step S412. Step S411 is indicated as optional, in FIG. 4A, by the use of dashed lines.

In step S412, marking engine 308 may transfer one or more rendered test patch images from a photoreceptor or from an intermediate transfer belt, as described above with respect to FIG. 1, FIG. 2, FIG. 3A and FIG. 3B, and operation of the method continues to step S414.

In step S414, RM/A analysis unit 306 may receive an RM/A sensor signal containing RM/A sensor data corresponding to residual toner image remaining as a result of the transfer of a test patch with a transfer field generated using a combined transfer/perturbation signal, and operation of the method continues to step S416.

In step S416, RM/A analysis unit 306 may filter the received sensor output, e.g., either a post transfer RM/A signal from a post transfer sensor or a transfer efficiency signal produced, for example, by combining signals from a pre-transfer RM/A sensor and a post-transfer RM/A sensor, with a high-pass filter, and operation of the method continues to step S418.

In step S418, the filtered sensor output may be mixed with a correlator signal to produce a correlated sensor signal, and operation of the method continues to step S420.

In step S420, the correlated sensor signal may be integrated over multiple integer periods of the perturbation frequency period to produce an estimate of the slope, $B_{1_EST}$ of the sensor output to transfer field at the current transfer field signal setting, E, and operation of the method continues to step S422.

If, in step S422, RM/A analysis unit 306 determines that the determined slope, $B_{1_EST}$, is less that the target slope, operation of the method continues to step S424, otherwise, operation of the method continues to step S426.

In step S424, if the determined slope, $B_{1_EST}$ is less than the target slope, RM/A analysis unit 306 may instruct transfer field controller 304 to increase the current transfer field signal setting, E, by a predetermine increment, and operation of the method continues to step S428.

In step S426, if the determined slope, $B_{1_EST}$, is greater than the target slope, RM/A analysis unit 306 may instruct transfer field controller 304 to decrease the current transfer field signal setting, E, by a predetermine decrement amount, and operation of the method continues to step S428.

If, in step S428, RM/A analysis unit 306 determines that the set transfer field has converged to a best set point, or determines that a maximum number of test patch cycles have been executed, or determines that a system power-down has been requested by the system operator, operation of the method continues to step S430 and operation of the method terminates, otherwise, operation of the method continues to step S408.

The process described above with respect to FIG. 4A and FIG. 4B may be repeated periodically by the RM/A analysis unit 306 for one or more toner image transfer devices within the xerographic system to make sure that the respective transfer fields maintain a desired transfer efficiency despite variations in operational conditions and/or variations in the materials, e.g., paper type, paper humidity, toner type, toner age/condition, that may adversely affect transfer efficiency, and/or other noise.

It is noted that in step S416, applying a high-pass filter to the received RM/A sensor signal has the effect of removing the DC term from equation 2 and equation 3, described below. Further, it is noted that integrating the correlated signal over multiple integer periods of the perturbation frequency period acts to both adjust the transfer field E to match the target and to remove the higher harmonic term, i.e., cos(2wt), described below with respect to equation 3.

Figure 5:
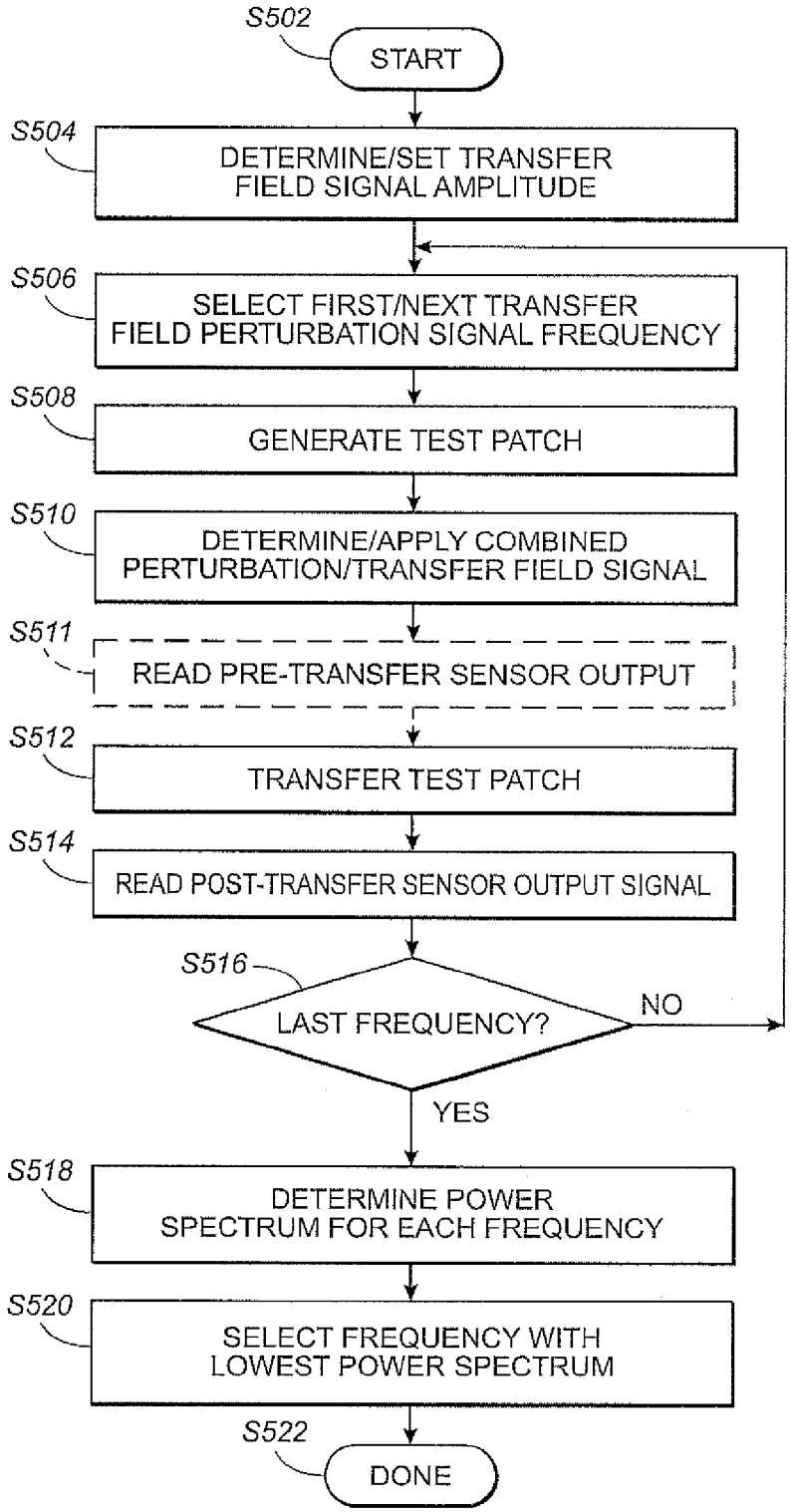
FIG. 5 is a flowchart illustrating of an exemplary method for determining a perturbation frequency for use in the process described in FIG. 4A and FIG. 4B.

FIG. 5 is a flowchart illustrating of an exemplary method for determining a perturbation frequency for use in the process described with respect in FIG. 4A at step 410. As shown in FIG. 5, operation of the method begins at step S502 with the startup of a xerographic system and proceeds to step S504.

In step S504, the transfer field controller 304 may determine a current transfer field signal setting, E, for each toner image transfer device in xerographic apparatus 100, e.g., based on control parameters provided by marking engine controller and/or the result of previous RM/A analysis process cycles, as described above with respect to FIG. 4A and FIG. 4B, and operation of the method continues to step S506.

In step S506, the RM/A analysis unit 306 may select a first/next perturbation frequency, ω, e.g., from a range of predetermined potential perturbation frequencies, and operation of the method continues to step S508.

In step S508, at the request of RM/A analysis unit 306, marking engine controller 302, may generate and may send to marking engine 308 for rendering, one or more test patches, e.g., solid toner patches each representing a toner color used by the marking engine, and operation of the method continues to step S510.

In step S510, at the request of RM/A analysis unit 306, transfer field high voltage power source 320 may generate, and apply to one or more toner image transfer devices, a combined transfer field signal that may include the current transfer field signal setting, E, and a perturbation signal, e.g., ΔE cos(ωt), based on a perturbation frequency selected by RM/A analysis unit 306 in step S506, and operation of the method continues to step S511.

In step S511, assuming that the xerographic system includes a pre-transfer RM/A sensor, RM/A analysis unit 306 may receive, and may store, an RM/A sensor signal containing RM/A sensor data corresponding to a toner image prior to transfer of a test patch, and operation of the method continues to step S512. Step S511 is indicated as optional, in FIG. 5, by the use of dashed lines.

In step S512, marking engine 308 may transfer one or more rendered test patch toner images from a photoreceptor or from an intermediate transfer belt, as described above with respect to FIG. 3A and FIG. 3B, and operation of the method continues to step S514.

In step S514, RM/A analysis unit 306 may receive, and may store, an RM/A sensor signal containing RM/A sensor data corresponding to a residual toner image left as a result of the transfer of a test patch with a transfer field generated using a combined transfer/perturbation signal, and operation of the method continues to step S516.

If, in step S516, RM/A analysis unit 306 determines that the last perturbation frequency has been selected, operation of the method continues to step S518, otherwise, operation of the method continues to step S506.

In step S518, RM/A analysis unit 306 may determine and store a power spectrum for post-transfer RM/A sensor signals, and/or may determine and store a power spectrum for transfer efficiency output produced by, for example, combining pre-transfer RM/A sensor signals with post-transfer RM/A sensor signals, generated for each perturbation frequency, ω, and operation of the method continues to step S520.

In step S520, RM/A analysis unit 306 may select the perturbation frequency, ω, with the lowest power spectrum for use in analyzing RM/A toner image transfer efficiency, for example, as described above with respect to FIG. 4A and FIG. 4B, and operation of the method continues to step S522 and the method terminates.

The process described above with respect to FIG. 5 may be repeated periodically by the RM/A analysis unit 306 to make sure that the dynamic transfer field adjustment process performed by RM/A analysis unit 306 is performed using a perturbation frequency that results in RM/A sensor data based on an optimal signal-to-noise ratio. However, some embodiments may use a perturbation frequency which is pre-selected based on an one-time informed design decision or based on a one time analysis of the noise present in the operational environment using, for example, the process described above with respect to FIG. 5.

Figure 6:
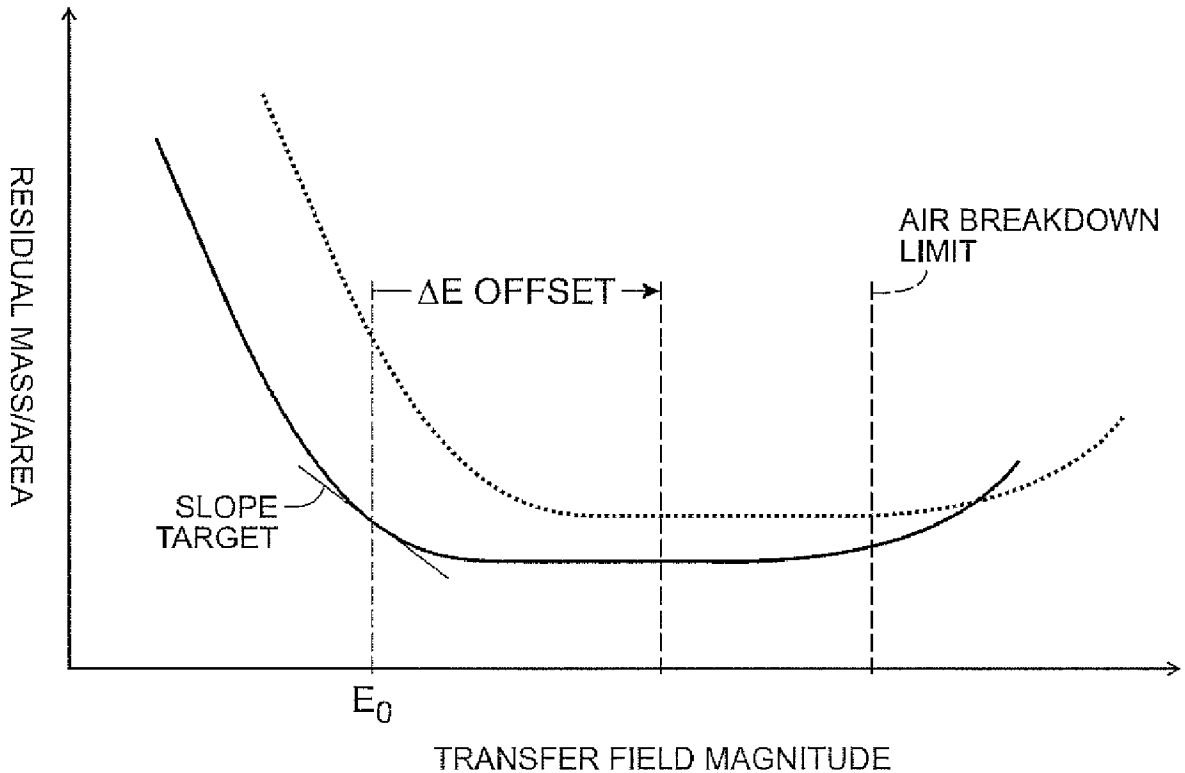
FIG. 6 is a plot of residual mass per area in response to range of transfer field magnitudes.

FIG. 6 is a plot of residual mass per area in response to transfer field magnitude. As previously described with respect to FIG. 1, an intermediate transfer belt transfer station may include at least one backup roller on one side of the intermediate transfer belt. The backup roller may form a nip 121 between the intermediate transfer belt 111 and biased transfer roller 124 so that media 130 passes over the transfer roller 124 in close proximity to or in contact with the complete toner image on the intermediate transfer belt 111. The transfer field at the nip pulls the toner image from the intermediate transfer belt 111 onto the media 130. As previously described with respect to FIG. 2, photoreceptor transfer station 250 may include a biased transfer roller 252 arranged to form a nip 253 on the intermediate transfer belt 111 for transfer of the toner image onto the intermediate transfer belt 111 from photoreceptor surface 202. The transfer field applied to the roller 252 may draw the toner image 231 from the photoreceptor surface 202 to the adjacent surface of the intermediate transfer belt 111 at the nip.

As shown in FIG. 6, the plot of residual mass per area in response to transfer field magnitude includes a flat region, i.e., having a slope equal to zero, at which the toner residual mass per area is at a minimum. The residual mass to transfer field functional relationship may be represented by the equation $$RMA(E)=\beta_0+\beta_1*(E-E_0)+0.5*\beta_{11}(E-E_0)^2 \quad \text{Eq. 1}$$

Where RM/A is the residual mass per area at an applied transfer field;

E is the applied transfer field; and $E_0$ is the transfer field at which a target slope, $\beta_{1_target}$, is achieved;

$E-E_0$ is an offset applied to $E_0$.

According to the described approach, an transfer field magnitude, $E_0$, is determined that has a slope close to, or slightly less than, zero, such that application of a small predetermined offset, $E-E_0$, achieves a minimum RM/A response that remains stable for small fluctuations in the transfer field magnitude. One consideration in choosing offset, $E-E_0$, is to make the offset sufficiently small to avoid air break down prior to the entrance of the transfer nip. Air breakdown, see FIG. 6, is undesirable prior to the transfer nip because the ionization of air can reverse the charge sign on the toner so the transfer field exerts a force on the toner particle in the opposite direction than that required.

In one example embodiment, a current transfer field signal setting, E, may be perturbed with an input signal $E+\Delta E\cos(\omega t)$, which, when inserted into equation 1 transforms the equation to:

$$RMA(E+\Delta E\cos(\omega t)) = \beta_0 + \beta_1 * (E+\Delta E\cos(\omega t) - E_0) + .5 * \beta_{11}(E+\Delta E\cos(\omega t) - E_0)^2 \quad \text{Eq. 2}$$

which equals $$= (\beta_0 + .25 * \beta_{11} * \Delta E^2) + \beta_1 * \Delta E\cos(\omega t) + .25 * \beta_{11}\Delta E^2\cos(2\omega t) \quad \text{Eq. 3}$$

Where RM/A is the residual mass per area at an applied transfer field;

E is the applied transfer field; and $\Delta E\cos(\omega t)$ is the applied perturbation signal.

According to the described approach a perturbed signal, $E+\Delta E\cos(\omega t)$ is applied to a toner image transfer device, and the residual mass per area is measured with an RM/A sensor to produce an RM/A data signal, which is correlated with a correlator signal, $\cos(\omega t)$, and the resulting signal is integrated over multiples of the period to obtain an estimate of the slope $\beta_{1_est}$ at applied transfer field, E. If the estimated slope, $\beta_{1_est}$, is less that the target slope, the applied transfer field may be incremented by a predetermined amount. If the estimated slope, $\beta_{1_est}$, is greater that the target slope, the greater than the applied transfer field may be decremented by a predetermined amount.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A method of adjusting a transfer field within a marking engine, the method comprising:

applying a first transfer field to a transfer device based on a first transfer field signal;

modifying the first transfer field based on a first transfer field perturbation signal modified with the first transfer field signal;

transferring a toner image from a toner image source to a toner image destination via the transfer device with the modified first transfer field;

receiving a signal based at least in part on a residual toner mass remaining on the toner image source after the transfer;

determining a slope of the received signal; and adjusting the first transfer field signal to produce a second transfer field signal based on the slope of the received signal.

2. The method of claim 1, wherein the first transfer field perturbation signal is of the form $\Delta E\cos(\omega t)$, where $\Delta E$ corresponds to a predetermined offset of the first transfer field, $\omega$ corresponds to a perturbation frequency, and t corresponds to time.

3. The method of claim 1, wherein determining the slope of the received signal comprises:

filtering the received signal with a high-pass filter.

4. The method of claim 3, wherein determining the slope of the received signal further comprises:

correlating the filtered signal with a correlator signal.

5. The method of claim 4, wherein the correlator signal is of a form $\cos(\omega t)$, where $\omega$ corresponds to a perturbation frequency, and t corresponds to time.

6. The method of claim 4, wherein determining the slope of the received signal further comprises:

integrating the correlated signal.

7. The method of claim 1, wherein adjusting the first transfer field signal to produce a second transfer field signal comprises:

increasing the first transfer field signal if the determined slope is less than a target slope.

8. The method of claim 1, wherein adjusting the first transfer field signal to produce a second transfer field signal comprises:

decreasing the first transfer field signal if the determined slope is greater than a target slope.

9. The method of claim 1, wherein the toner image source is one of a photoreceptor and an intermediate transfer belt.

10. The method of claim 1, wherein the received signal includes a measure of toner transfer efficiency.

11. A xerographic marking engine, comprising:

a transfer field controller that generates a first transfer field control signal;

an analysis unit that generates a perturbation control signal;

a transfer field high voltage power source that generates a transfer field driving signal based on the first transfer field control signal and the perturbation control signal;

one or more toner image transfer devices that transfers a toner image from a toner image source to a toner image destination using a transfer field generated based on the transfer field driving signal; and one or more sensors that generate a sensor signal based at least in part on a residual toner mass remaining on the toner image source after the transfer, wherein the analysis unit updates the first transfer field control signal based on the sensor signal.

12. The xerographic marking engine of claim 11, wherein the perturbation control signal is of the form $\Delta E\cos(\omega t)$, where $\Delta E$ corresponds to a predetermined offset of the first transfer field, $\omega$ corresponds to a perturbation frequency, and t corresponds to time.

13. The xerographic marking engine of claim 11, wherein the analysis unit comprises:

a high-pass filter that filters the sensor signal.

14. The xerographic marking engine of claim 13, wherein the analysis unit comprises:

a correlator that correlates the filtered signal with a correlator signal.

15. The xerographic marking engine of claim 14, wherein the correlator signal is of a form cos(ωt), where ω corresponds to a perturbation frequency, and t corresponds to time.

16. The xerographic marking engine of claim 14, wherein the analysis unit integrates the correlated signal to achieve a slope of the sensor signal.

17. The xerographic marking engine of claim 16, wherein the analysis unit one of increases the transfer field control signal if the determined slope is less than a target slope and decreases the first transfer control field signal if the determined slope is greater than a target slope.

18. The xerographic marking engine of claim 11, wherein the toner image source is one of a photoreceptor and an intermediate transfer belt.

19. The xerographic marking engine of claim 11, wherein the generated sensor signal includes a measure of toner transfer efficiency.

20. A xerographic image forming device comprising the xerographic marking engine of claim 11.

* * * * *